United States Patent [19]

Colinet

[11] 4,057,271

[45] Nov. 8, 1977

[54] AUTOMOBILE BONNET EJECTION AND RETAINING DEVICE

[75] Inventor: André Colinet, Boulogne-Billancourt, France

[73] Assignees: Regie Nationale des Usines Renault, Boulogne-Billancourt; Automobiles Peugeot, Paris, both of France

[21] Appl. No.: 655,390

[22] Filed: Feb. 5, 1976

[30] Foreign Application Priority Data

Feb. 7, 1975 France ..... 75.03872

[51] Int. Cl.[2] ..... E05C 19/06

[52] U.S. Cl. ..... 292/87; 292/102; 292/DIG. 14; 292/DIG. 72

[58] Field of Search ..... 292/DIG. 14, DIG. 72, 292/89, 87, 102, 107, 108, 209, 228

[56] References Cited

U.S. PATENT DOCUMENTS

| | | | |
|---|---|---|---|
| 1,372,812 | 3/1921 | Harmon | 292/87 X |
| 1,424,673 | 8/1922 | Orendorff | 292/87 |
| 2,622,907 | 12/1952 | Hynes | 292/DIG. 14 |
| 2,729,487 | 1/1956 | Krause et al. | 292/DIG. 14 |

*Primary Examiner*—Roy D. Frazier
*Assistant Examiner*—Rodney H. Bonck
*Attorney, Agent, or Firm*—Fleit & Jacobson

[57] ABSTRACT

Device for ejecting and retaining the bonnet of a motor vehicle when opening said bonnet, which comprises an ejection spring and a hook adapted to retain the bonnet in its ejected position, said device consisting of a spring assembly comprising a portion adapted to be fastened and, adjacent thereto, a spring arm constituting the ejection member and another spring arm constituting the retaining hook, said other spring arm being provided with a control lug.

6 Claims, 7 Drawing Figures

Fig - 1
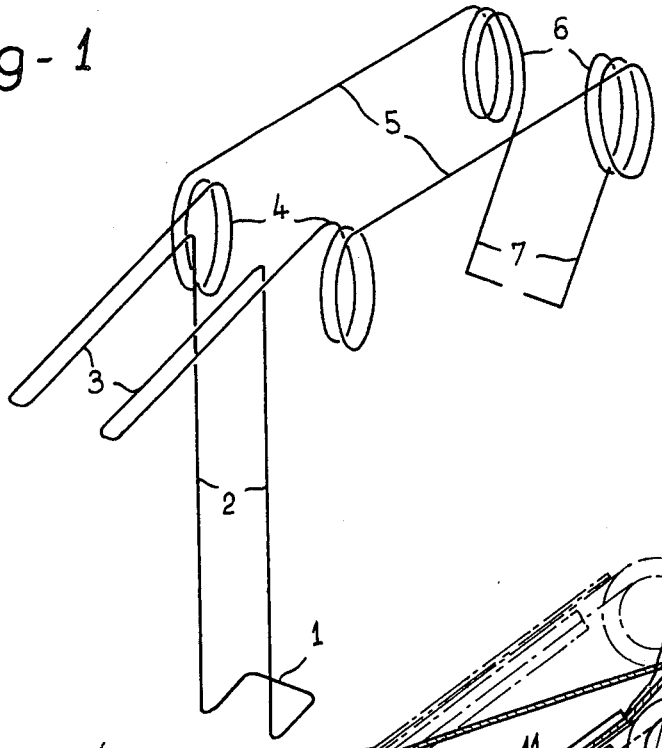
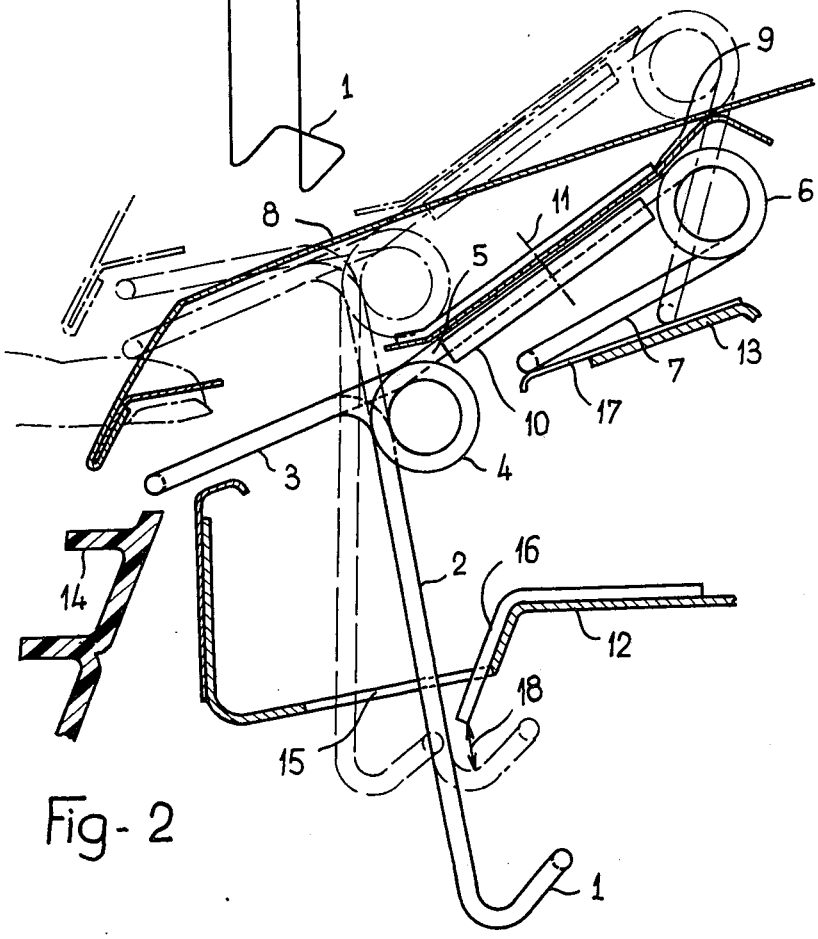
Fig - 2

Fig- 3
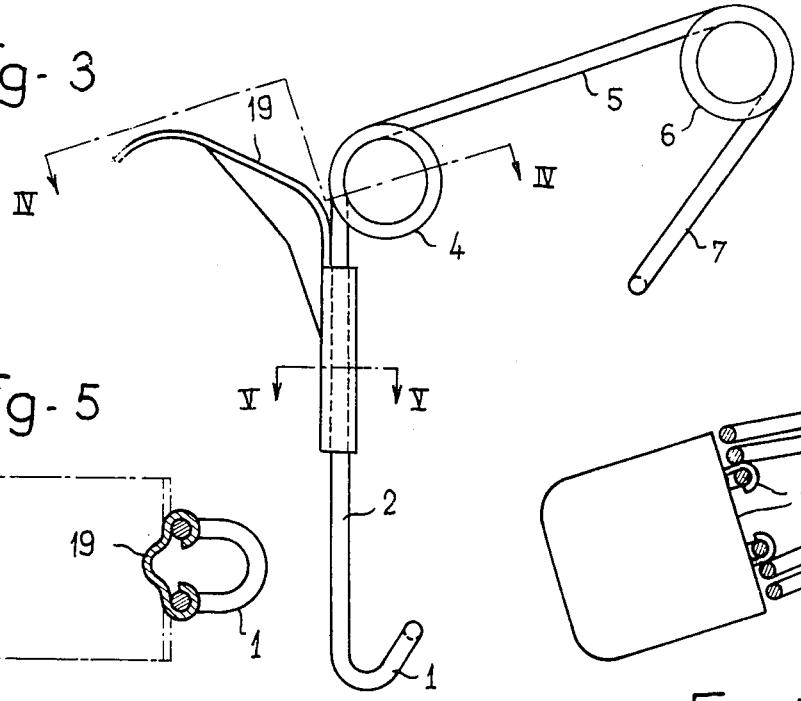
Fig- 5
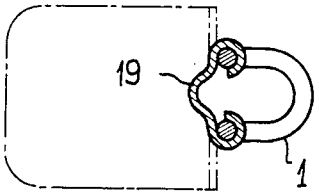
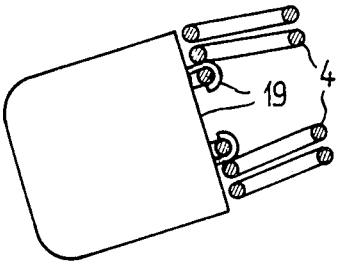
Fig- 4
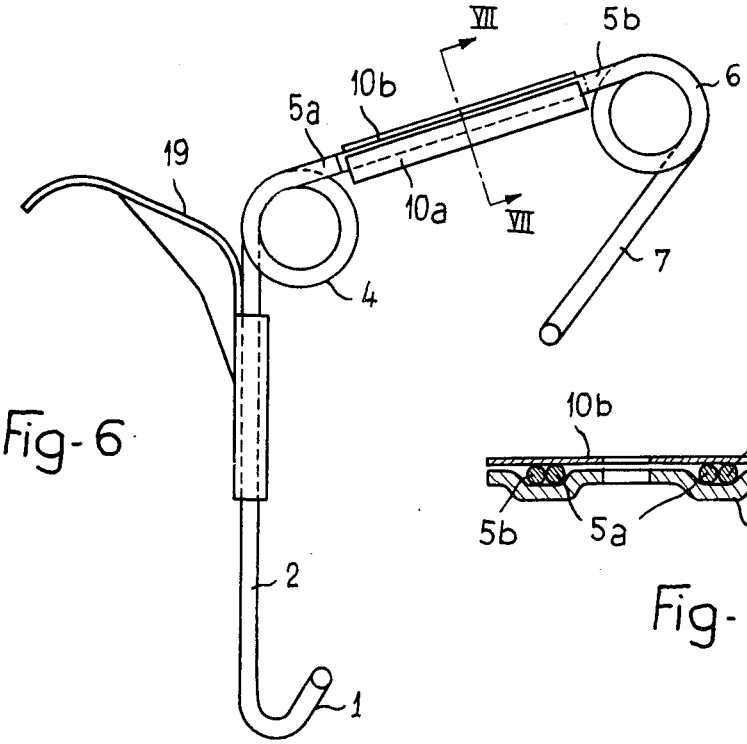
Fig- 6
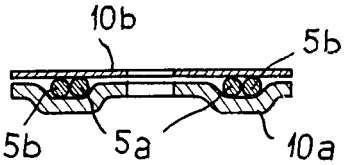
Fig- 7

AUTOMOBILE BONNET EJECTION AND RETAINING DEVICE

The present invention relates in general to devices for ejecting and retaining the bonnet of motor vehicles.

In motor vehicles equipped with a front bonnet opening in the rearward direction it is a safety must to provide compulsorily, in addition to the main locking system, an auxiliary retaining device for palliating possible failures or untimely actuations of the first or main system, this auxiliary retaining device having separate control means independent of those controlling the main locking device. Besides, an ejection system must also be provided which, when the main locking device is released, permits a partial opening or movement of the bonnet from its closed position, in order to facilitate the subsequent gripping thereof for opening the bonnet completely.

In hitherto known arrangements of this character the ejection system, comprising in most cases a spring, is either independent or associated with the main locking system. The retaining hook or like member consists on the other hand of a bracket, a hook member and a spring for permitting the return thereof after its actuation.

Other retaining devices are also known wherein the hook member consists simply of an extension of the return spring.

However, these prior art devices are objectionable on account of a relatively high cost due to the dispersion of their component elements under the bonnet, which entails the use of separate fastening means and requires therefore a longer assembly time.

The present invention is directed to an improved device for ejecting and retaining the bonnet of a motor vehicle, which is of simplified and compact construction, and requires only one fastening member.

Basically, the device according to this invention which comprises an ejection spring and a hook for retaining the bonnet in the ejected position, is characterized in that it consists of a spring loaded assembly including a portion intended for fastening the device and, adjacent thereto, a spring arm acting as an ejection member and another spring arm constituting the retaining hook, said other spring arm comprising an integral control lug.

More particularly, said fastening portion and said spring arms may constitute a single spring, and likewise said control lug may be formed as an integral portion of the hook-forming spring arm.

Several forms of embodiment of the bonnet ejection and retaining device according to this invention will now be described by way of illustration with reference to the accompanying drawing, in which:

FIG. 1 is a perspective view of a spring constituting the device of this invention;

FIG. 2 is a side elevational view of the bonnet ejection and retaining device consisting of a one-piece spring of the type illustrated in FIG. 1, various members co-acting therewith being shown in part-sectional view, the device and the associated bonnet portion being also shown in various positions of operation;

FIG. 3 is a side elevational view of a modified form of embodiment of the spring;

FIGS. 4 and 5 are sections taken along the lines IV—IV and V—V of FIG. 3;

FIG. 6 is a side elevational view of another modified form of embodiment of the spring assembly, and FIG. 7 is a section taken along the line VII—VII of FIG. 6.

The device illustrated in FIGS. 1 and 2 of the drawing comprises essentially a spring consisting of a piece of steel wire bent and wound in such a manner that it constitutes a hook 1 at one end of a double-wire arm 2 having formed at its other end a control lug 3 connected through several windings or turns 4 to the end of a central double-wire portion 5 by which the spring is adapted to be fastened, the other end of this central portion 5 being also connected through several windings or turns 6 to one arm of a double wire assembly 7 constituting the ejection member.

As illustrated in FIG. 2, this spring is secured under the bonnet 8 of the vehicle, in the vicinity of its front opening edge, in this example under a supporting member 9 secured to the bonnet. This spring is secured in position by means of a clamping plate or strap 10 holding the central double-wire portion 5, a suitable fastening member, for example a bolt or rivet 11, extending through the plate or strap 10 and also through said supporting member 9.

The arms 2 and 7 of the spring co-act with portions 12 and 13 of a fixed cross member of the vehicle body, inside the front grille thereof shown diagrammatically at 14. The arm 2 forming the hook 1, in the closed bonnet position (shown in thick lines in FIG. 2), extends through an aperture 15 formed in portion 12 of said cross member, with the assistance of a projecting reinforcing element 16 engageable by said hook 1.

When closing the bonnet, the arm 7 is somewhat stressed by engaging the fixed portion 13 of said cross member which in this example is provided with a wear or slide plate 17, so as to move towards the central portion 5, whereby the turns or windings 6 are also stressed.

Thus, when the conventional main bonnet locking device (not shown but of any suitable type for the purposes of the present invention) is released either voluntarily or accidentally, the above-described auxiliary device will firstly act as an ejection device so as to allow the bonnet to be snapped to the position shown in dash and dot lines by the spring force obtained by allowing the turns 6 to expand and also from the reaction of arm 7 against said wear plate 17, while the hook 1 of arm 2 is moved to a position in which it registers directly with, and is close to, the projecting reinforcing member 16, so as to positively retain the bonnet, if its opening movement were protracted along a stroke denoted by the double arrow 18. This stroke 18 is calculated to permit an easy escape of the retaining hook 1 in relation to said projecting reinforcing member 16 when it is desired to open the bonnet voluntarily; this operation is then performed by inserting a finger, as shown, under said control lug 3 and lifting the latter so as to carry along the arm 2 and hook 1 to the release position shown in dash lines in FIG. 2, whereby the hook 1 will freely clear said aperture 15 when, during the same movement, the user attempts to raise the bonnet after lifting the lug 3.

The bonnet can be reclosed without exerting any particular care, the hook 1 then slipping on the projecting reinforcing member 16 before resiliently resuming its position in front thereof as shown in thick lines in the drawing.

FIGS. 3 to 5 illustrate a modified form of embodiment wherein the control lug, instead of being an integral portion of the wire spring, consists of a member 19 fastened to the arm 2 of said spring and is cut from a sheet metal blank and crimped to said arm 2, as shown; alternatively, a rigid plastic member adapted to be fitted by snap engagement to the arm 2 may also be used.

FIGS. 6 and 7 illustrate a modification of the preceding form of embodiment, wherein the spring consists of two parts, its central fastening portion consisting on the other hand of a double wire section 5*a* connected by windings or turns 4 to said arm 2 and of another double wire section 5*b* connected by the other windings or turns 6 to the other arm 7, said arms 2 and 7 being assembled in side by side relationship under a clamping and fastening strap or plate made of two cooperating sections 10*a* and 10*b*. With this arrangement, it is possible to use steel wires of different diameters for the hook and the ejection spring.

Although specific forms of embodiment of this invention have been described hereinabove and illustrated in the accompanying drawing, it will be readily understood by those conversant with the art that various modifications and changes may be brought thereto without departing from the scope of the invention as set forth in the appended claims.

What is claimed as new is:

1. A bonnet ejection and retaining device for use in a motor vehicle having a bonnet movable between a locked position, a partially open position and a fully open position, and including a main bonnet locking device having one component attached to the bonnet engageable with another component attached to another part of the motor vehicle to hold the bonnet in the locked position, ejection means operable upon the release of the components of the main bonnet locking device from each other for moving the bonnet from the locked towards the fully open position, and retention means having a first component attached to the bonnet engageable with a second component attached to another part of the motor vehicle to stop the movement of the bonnet towards the fully open position and to releasably hold the bonnet in the partially open position, the improvement wherein said ejection means and one of said two components of said retention means are combined into the bonnet ejection and retaining device comprised of: a fastening member for fastening the device to the motor vehicle; an ejection spring means connected to said fastening member and operable upon the release of the components of the main bonnet locking device for moving the bonnet from the locked position towards the fully open position; and a hook assembly means having a first portion connected to said fastening member, a hook arm forming said one component of said retention means, a control lug, and a wound spring integral with said hook arm and connected to said first portion, the hook arm being free from engagement with the other of said two components of said retention means when said bonnet is in the locked position and being releasably engaged by the other of said two components during movement of the bonnet from the locked position to releasably hold the bonnet in the partially open position, the control lug being operable to release said hook arm from engagement with said other component so that the bonnet can be moved from the partially open to the fully open position.

2. The improvement according to claim 1, wherein said ejection spring means and said hook assembly means are formed of a single, one-piece spring.

3. The improvement according to claim 1 wherein said hook assembly means comprises a single, one-piece spring having a second portion forming said hook arm, a third portion connected to said first portion and forming said control lug, and the wound spring connects said second and third portions to said first portion.

4. The improvement according to claim 3 wherein said second and third portions are so arranged that said hook arm is released from engagement when said control lug is lifted.

5. The improvement according to claim 1 wherein said ejection spring means comprises a single, one-piece spring having a downwardly extending spring arm forming an ejection member, a portion connected to said fastening member and a wound portion forming an ejection spring and connecting said spring arm to said connected portion.

6. The improvement according to claim 1 wherein the fastening member is adapted to fasten the device to the bonnet of the motor vehicle.

* * * * *